United States Patent [19]

Benasutti et al.

[11] 4,036,620

[45] July 19, 1977

[54] WATER CHILLING TANK FOR REFRIGERATOR

[75] Inventors: Louis D. Benasutti, Fairborn; Jost S. Sucro, Dayton, both of Ohio

[73] Assignee: General Motors Corporation, Detroit, Mich.

[21] Appl. No.: 692,971

[22] Filed: June 4, 1976

[51] Int. Cl.[2] ..... F25D 23/12; B67D 5/62

[52] U.S. Cl. ..... 62/338; 62/391; 222/146 C

[58] Field of Search ..... 62/338, 391; 222/146 C

[56] References Cited

U.S. PATENT DOCUMENTS

| | | | |
|---|---|---|---|
| 2,477,210 | 7/1949 | Skinner | 62/339 |
| 3,511,415 | 5/1970 | Crowe | 62/339 |
| 3,696,632 | 10/1972 | Carlin et al. | 62/285 |
| 3,834,178 | 9/1974 | Pink | 62/338 |
| 3,914,957 | 10/1975 | Jacobs | 62/338 |

*Primary Examiner*—Lloyd L. King
*Attorney, Agent, or Firm*—Edward P. Barthel

[57] ABSTRACT

A refrigerator cabinet water storage tank is oriented horizontally on the floor of the fresh food compartment and includes first and second side-by-side water storage chambers interconnected by a cross-over passage having a continuous taper which constantly increases the cross-sectional areas from the first chamber inlet to the second chamber outlet. The tank allows the water to enter from a domestic water source at a point lower than the exit tube outlet with the outlet arranged at the tank's highest point obviating the entrapment of air within the tank. The tank has an internal configuration providing maximum internal volume while fitting into a limited space. The water flow through the tank follows a serpentine U-shaped path to promote water turbulence which will provide maximum heat transfer.

3 Claims, 8 Drawing Figures

WATER CHILLING TANK FOR REFRIGERATOR

This invention relates to domestic refrigerators and more particularly to a side-by-side refrigerator having a cold water storage tank in the fresh food compartment thereof.

The prior art as exemplified by U.S. Pat. No. 3,788,094, assigned to the assignee of the instant application, discloses a top freezer refrigerator having a cold water service area located in the exterior of the door with a water line leading from a cold water storage tank within the above-freezing portion of the cabinet to a dispensing valve in the service area. It is an object of the present invention to provide an improved water storage tank for a freezer-refrigerator which is positioned horizontally on the floor of the fresh food compartment of a refrigerator and has a configuration which permits water to enter an inlet on one side edge of the tank's medial plane and after traversing a meandering U-shaped slow flow path exits the tank at its highest point while any entrapped air traverses a minimal U-shaped fast bleed path to assure that the tank is purged of all air.

It is another object of the present invention to provide an improved water storage tank designed to maximize its internal volume for location within a limited space by providing first and second side-by-side elongated generally cylindrical sectioned water storing chambers connected by a cross-over passage formed with a generally semi-circular cross section connecting the closed ends of the chambers. The first chamber, the cross-over passage and the second chamber have a continuous taper which constantly increases the cross-sectional areas from the first chamber inlet to the second chamber outlet to obviate the entrapment of air within the tank.

It is still another object of the present invention to provide improved water storage heat transfer tank having first and second side-by-side elongated generally cylindrical sectioned water storage chambers formed by upper and lower half shells of plastic material sealed together along a horizontally disposed generally rectangular seam which circumscribes the shells and includes one portion forming a seam plate which bisects the first and second chambers. The first chamber having an inlet and the second chamber having an outlet which are both located adjacent the seam's one side edge while a cross-over passage interconnects the chambers adjacent the seam opposite side edge. The seam has a portion on its one side edge offset upwardly a predetermined distance from the seam plane such that an integral inlet tube extending from the one side edge connecting with the first chamber inlet and an integral inlet tube extending from the offset seam portion of the one side edge connecting with the second chamber outlet at a location substantially tangent with the second chamber's highest point of curvature, whereby water follows a U-shaped flow path and wherein the water exits from the second chamber outlet at the container's highest point obviates the entrapment of air within the container.

It is still another object of the present invention to provide a water storage tank wherein the first and second side-by-side chambers are formed with a plurality of inwardly directed arcuate portions formed in staggered relation on the opposite sides thereof such that the incoming water is made to change directions defining an undulated substantially last-in, last-out constantly diverging U-shaped flow path between the inlet and the outlet of the chambers.

Further objects and advantages will become more apparent from the following specification, reference being had to the accompanying drawings of which:

Figure 1:
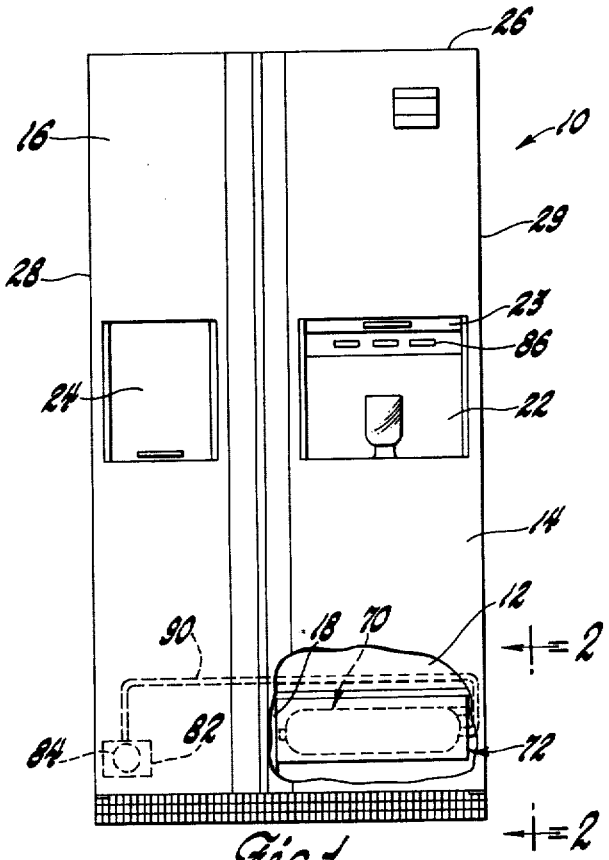
FIG. 1 is a front elevational view of a side-by-side refrigerator incorporating the present invention.

Referring now to the drawings, there is shown in FIG. 1 a refrigerator cabinet 10, generally referred to as a side-by-side refrigerator-freezer-refrigerator having a fresh food compartment 12 enclosed by a door 14 and a freezer compartment (not shown) closed by a door 16 separated by a vertically disposed insulating partition 18. In the disclosed embodiment a water and juice service area 22, having a vertically sliding access panel 23, is provided in the face of the right-hand fresh food compartment door 14 and an ice dispensing service area, shown closed by access panel 24, is provided in the face of the freezer door 16 enclosing the access opening to the freezer compartment. The cabinet includes an outer metal shell providing insulated top outer wall 26, back wall 27 and side walls 28, 29, the inner surfaces of which extend rearwardly from the cabinet front opening, and having disposed therebetween in the right side compartment a plurality of shelves (not shown) and lower storage pan 30 located above the cabinet insulated bottom wall in the form of an irregular bottom wall 31.

Figure 2:
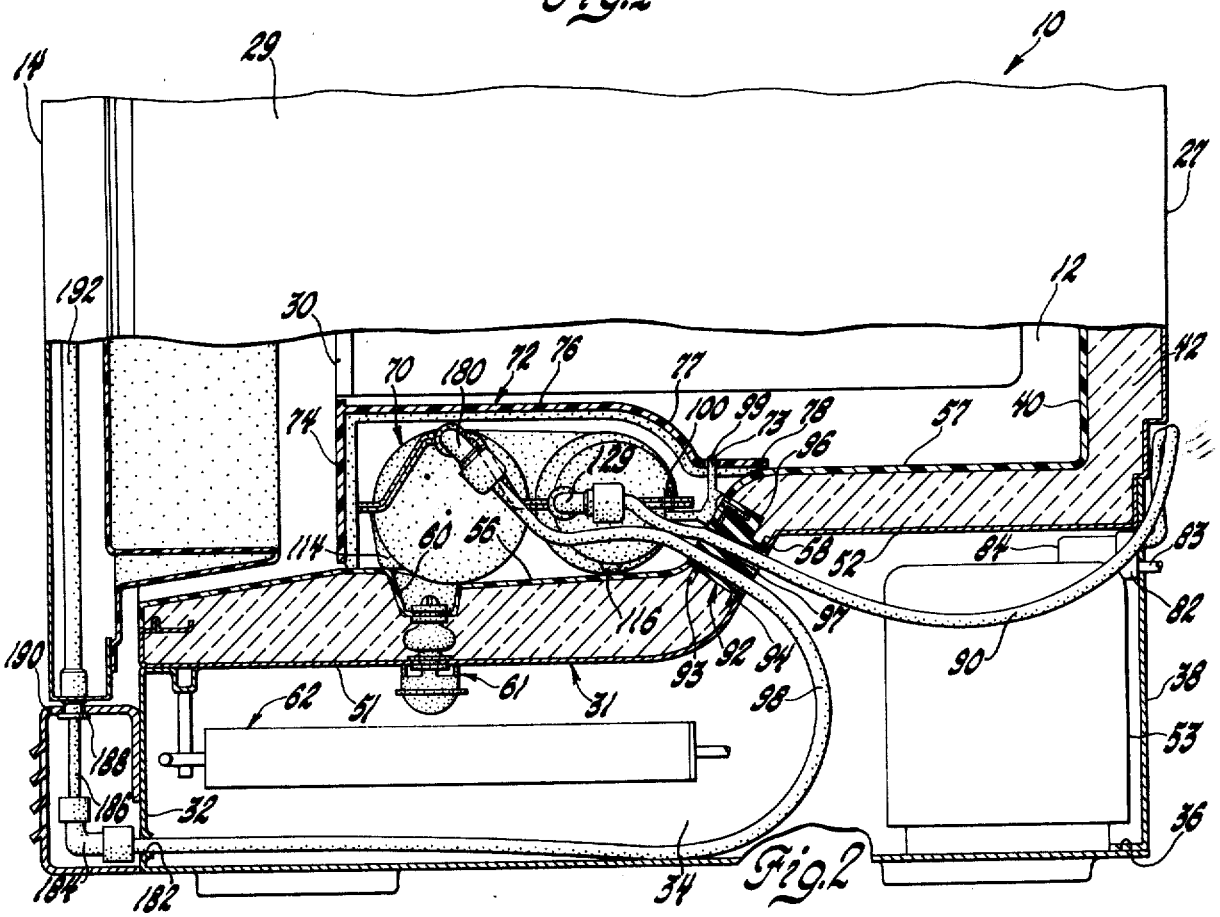
FIG. 2 is an enlarged vertical fragmentary view partially in cross-section, taken generally along the line 2—2 of FIG. 1.

The insulated cabinet, as seen in FIG. 2, includes a support base 32 which encloses a machinery compartment 34 having a rear access opening 36 formed in the back of the support base 32 enclosed by a plate 38. Within the outer shell of the cabinet is located an inner plastic liner 40. Suitable insulation 42 fills the space between the liner 40 and the outer walls of the cabinet.

The refrigerator cabinet includes an air flow cooling system, as shown for example in U.S. Pat. No. 3,261,173 to Gold, assigned to the same assignee as the instant application. For purposes of the present invention it is unnecessary to indicate that the cooling system includes a motor-driven fan (not shown) for directing air through the freezer compartment, thence through grille openings, shown in U.S. Pat. No. 3,630,046, for distribution throughout the above-freezing food storage compartment 12.

As seen in FIG. 2, the bottom wall 31 includes a horizontal sheet metal lower front portion 51 and a higher stepped-up rear portion 52 of the outer shell which is raised substantially above the front portion 51 to provide adequate space beneath for a sealed motor-compressor unit 53 of the refrigeration system. Spaced from, and substantially parallel to the portions 51 and 52 of wall 30, is irregular bottom of plastic liner 40 of the refrigerator and supported from the adjacent outer side wall 31 by thermal foam insulation 42. The plastic liner bottom has a lower front portion 56 and a stepped-up rear wall 57 which is raised substantially above the front wall riser or offset portion 58 to provide adequate space beneath for the sealed motor compressor unit 53.

The lower liner wall 56 is inclined toward the front of the refrigerator and is formed with a depressed trough or recess 60 extending transversely across the lower liner wall to each of the inner side walls of the liner 40. The trough is sloped inwardly from both side walls to accord a circular opening therein positioned adjacent the side wall for location of the drain assembly 61, as described in detail in U.S. Pat. No. 3,696,632 to Carlin et al. It will be noted that a superheat coil 62 in the machinery compartment is a tube and fin coil located adjacent the center of the compartment and is laterally spaced from the drain assembly 61. As seen in the aforementioned Carlin et al patent, a drain pan (not shown) extends substantially throughout the floor of the machinery compartment to provide maximum liquid exposure such that additional heating means is not required for evaporation of the drain water.

As seen in FIG. 1, a water cooler receptacle tank or container, indicated generally by dashed lines at 70, for supplying cold water to the service area 22 in the fresh food compartment door 14 is positioned on the forward portion 56 of the liner bottom wall. A plastic cover member 72 includes a front wall 74 substantially flush with the front wall of the overlying hydrator drawer 30 and a top horizontal wall 76 formed with an arcuate portion 77 terminating in a horizontal rear flange 78 supported on the step-up rear portion 57 of the liner. The cover conceals the water storage tank 70 during normal use of the refrigerator. The water cooler receptacle tank 70 is connected through a solenoid operated valve 82 to a high pressure water supply line 83. The control valve is shown located adjacent the rearward juncture of sidewall 28 and bottom wall portion 52 of the refrigerator and is actuated in response to the energization and deenergization of an electric solenoid 84 associated therewith upon the pressure being exerted upon an actuator 86 in the water and juice service area 22, as shown and described in U.S. Pat. No. 3,949,903 to Benasutti, et al, and assigned to the same assignee as the instant application. The water tank is exposed to the low temperature within the food compartment so as to be effectively cooled thereby.

A flexible plastic tube 90 extends via an opening in the back plate 38 of the refrigerator machinery compartment from the control valve 82 through a duct in the bottom wall riser portion 58. The duct 92, preferably molded of a plastic material, includes a tubular member having forward and rearward flanges 93, 94 contacting the inner faces of the liner and outer shell, respectively. The duct 92 includes a boss portion 96 integrally molded on its upper side. The boss portion 96 is formed with a bore adapted to receive suitable threaded fastener means to retain the duct firmly in place. The duct and structural support member 92, which is foam sealed to the liner, is molded with a center partition 97 which separates the duct into a pair of conduits, the upper one receiving the water inlet tube 90 while the lower conduit provides a passageway for a chilled water exit tube 98. The upper and lower duct conduits are preferably outwardly flared so as to diverge toward the machinery compartment 59 to allow for the ready feeding of the tubes 90 and 98 therethrough during assembly of the refrigerator cabinet.

It will be noted in FIG. 2 that the duct member 92 includes a pair of integral locating pegs 99 and 100 with the peg 99 adapted to be received in cover opening 73 and the peg 100 adapted to be received in tank opening 101 (FIG. 3) to insure the correct positioning of the tank relative to the refrigerator cabinet. Also the tank 70 has integrally molded gusset support portions 114 and protuberances 116 on the underside thereof to horizontally position the tank 70 on the sloped bottom wall 56 of the cabinet.

Figure 7:
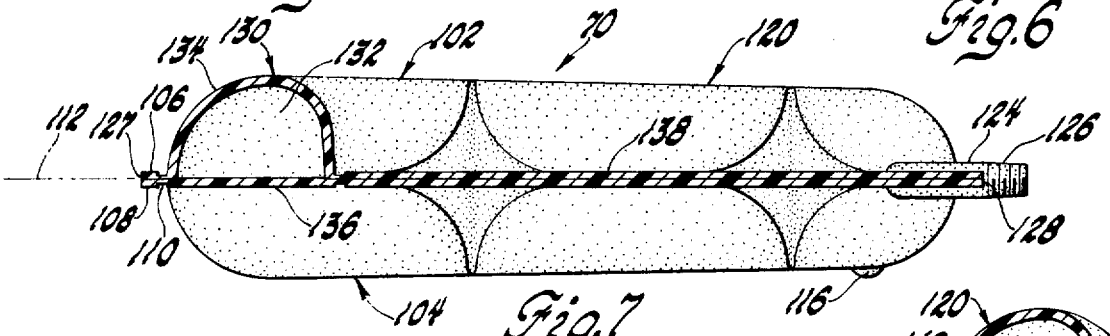
FIG. 7 is a vertical sectional view taken substantially along the line 7—7 of FIG. 3.
Figure 8:
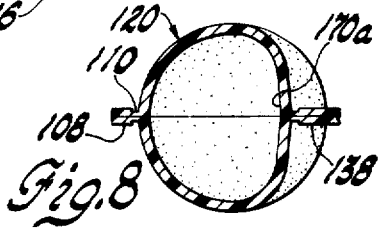
FIG. 8 is a sectional view taken substantially along the line 8—8 of FIG. 3.

FIGS. 3–8 illustrate the water storage cooling tank or container 70 in accordance with the present invention. As seen in FIG. 7, in general the tank is composed of two half shells 102 and 104 secured together by bonding their peripheral flanges 106 and 108, respectively, into a seam on weld line 110. In the preferred form the half shells are molded from plastic material such as polyethylene. The assembled water storage container or tank has first and second side-by-side elongated generally cylindrical sectioned water storage chambers, indicated generally at 120 and 121 respectively, formed by upper and lower downwardly and upwardly opening semi-circular channels formed in the upper and lower half shells 102 and 104 the peripheral flanges of which are sealed together at weld line 110 to form the horizontally disposed rectangular seam 100 as by heat-welding. In the preferred form the tank is designed to be fabricated in a blow molding operation wherein the weld line 110 is formed as part of the operation. The major portion of the seam 110 defines a medial plane bisecting the storage tank with the medial plane being shown in phantom and indicated by the reference numeral 112.

Figure 3:
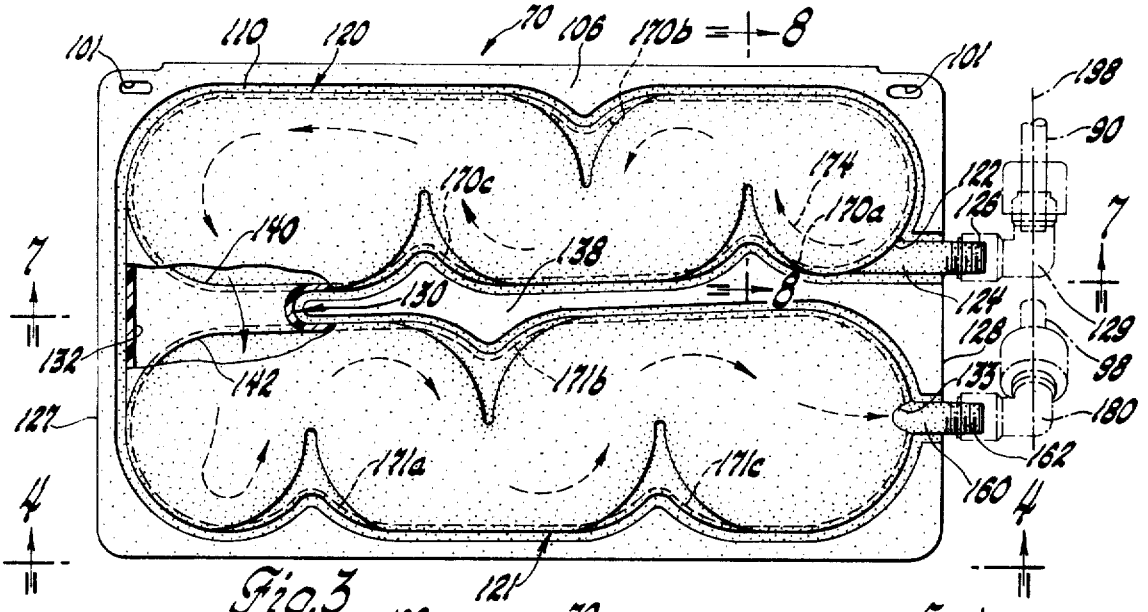
FIG. 3 is a top elevational view of the water storage tank of FIG. 2.
Figure 4:
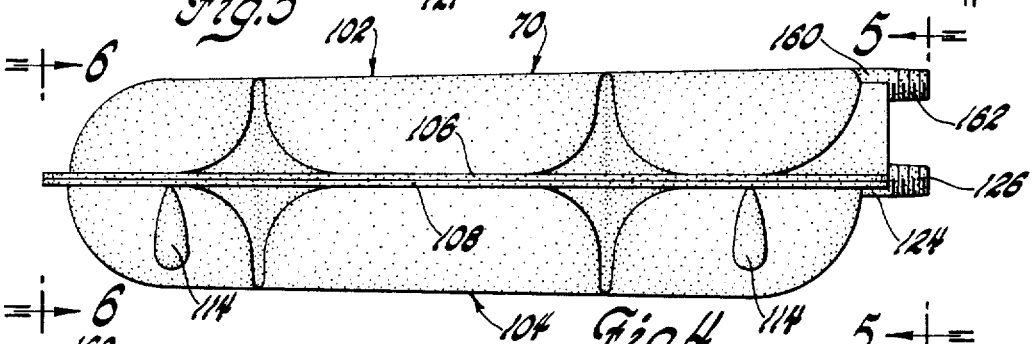
FIG. 4 is a side elevational view taken on the line 4—4 of FIG. 3.

The first storage chamber, generally indicated at 120, has an inlet 122 communicating with an inlet conduit 124 having a threaded nipple portion 126 extending outwardly beyond the right-hand side edge 128 of the seam 110 for receiving a suitable threaded 90° elbow connector 129 (FIG. 2) which connects the plastic inlet tube 90 with the tank conduit 124. As seen in FIGS. 3 and 7, the chamber inlet 122 is located so that conduit 124 is substantially tangent to the inner face of the first storage chamber 120 for a purpose to be explained hereinafter.

As best seen in FIGS. 3 and 7, a crossover portion 130 interconnects the first 120 and second 121 chambers at their closed ends adjacent the left-hand side edge 127. The crossover portion 130 includes a passage 132 which is molded in the upper shell 102 in the form of a downwardly opening generally arcuate sectioned channel 134 whose open end is sealed by a lower portion 136 of intermediate deck area 138 which defines a surface separating the storage chamber. As seen in FIG. 3, the crossover passage 132 provides communication between the exit 140 of the closed end portion of second storage chamber 121. It will be noted that because of their constantly diverging design the first chamber 120, the crossover passage 132 and the second chamber 121 have cross sections which constantly increase in area from the first chamber inlet 122 to the second chamber outlet 133.

Figure 5:
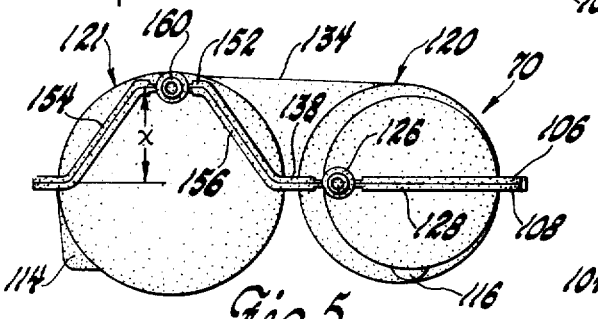
FIG. 5 is an end elevational view taken along the lines 5—5 of FIG. 4.
Figure 6:
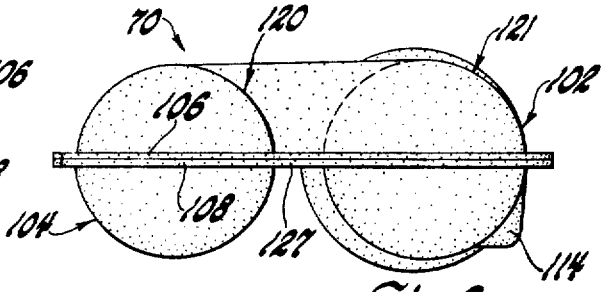
FIG. 6 is an end elevational view taken along the lines 6—6 of FIG. 4.

As best seen in FIG. 5, the seam 110 has a portion of its right-hand first side edge 128 offset upwardly a predetermined distance X from the plane 112 of the seam 110 defining offset seam edge 152 connected to the principal portions of the medial seam 110 by a pair of upwardly and inwardly converging symmetrical seam portions 154 and 156 each inclined at an angle approximately 55° from the horizontal. An integral outlet tube 160 is formed by the upper and lower portions of offset seam 152, which tube connects the second chamber outlet 133 with a threaded nipple portion 162. As viewed in FIG. 5 it will be seen that the outlet tube 160 is located substantially tangent with the second chamber's highest or zenith point of curvature.

With reference to FIG. 3, each of the first and second chambers 120 and 121 are formed with a plurality of inwardly directed curved portions in the form of generally arcuate concavo-convex baffles or segments 170*a*, 170*b* and 170*c* in chamber 120 and concavo-convex segments 171*a*, 171*b* and 171*c* in chamber 121. The centers of the curved segments are geometrically arranged to form partial spheres thus increasing the strength of the chambers 120 and 121.

The concave-convex segments in each of the chambers are arranged in staggered relation on opposite sides thereof with the convex face on the inner wall of the chambers whereby water entering inlet 122 is directed substantially tangent to a chamber wall where it contacts the curved baffle 170 and follows an undulating substantially serpentine flow path, indicated by dashed arrows 174 through first chamber 120, the crossover passage 132 and the second chamber 121 to exit via outlet tube 160 in a first-in, first-out manner. The meandering flow path promotes fluid turbulence providing maximum heat transfer insuring sufficient cooling of the water prior to being dispensed via a 90° elbow connector 180 to plastic tube 98. The tube 98 exits the machinery compartment 34 at aperture 182 in base wall 32 and flows through a 90° elbow 184 upwardly through conduit 186 through hinge pin 188, supported in hinge bracket 190, via tube 192 in fresh food door 14 to the water service area 22.

It will be noted in FIG. 3 that the inlet 129 and exit 180 elbow connectors are arranged with their right angle portions on a common center line 198 to allow the tank 70 to be easily rotated upwardly about the center line 198 for ready cleaning of the bottom wall 56 of the refrigerator cabinet.

As stated above, the cross-sectional area of the U-shaped passage defined by the first chamber 120, the crossover passage 132 and the second chamber 121 progressively enlarges as the tank outlet 133 is approached. This feature allows for any air bubles formed in the U-shaped passageway upon initial filling of the tank to be moved progressively toward the outlet 132 which is located at the highest elevation of the tank to obviate the possibility of any entrapped air bubbles being captured by the container.

While the embodiment of the present invention as herein disclosed constitutes a preferred form, it is to be understood that other forms might be adopted.

We claim:

1. A water container for installation in an above-freezing portion of a refrigerator to cool water supplied to the container through a water valve connected between the container having first and second side-by-side elongated generally cylindrical sectioned water storage chambers formed by upper and lower half shells sealed together along a horizontally disposed seam which circumscribes the shells and includes one portion forming a medial seam, said first chamber having an inlet and said second chamber having an outlet, said inlet and said outlet both located adjacent the seam's one side edge, a crossover passage interconnecting said chambers at their closed ends, said cross-over passage formed with a generally semi-circular cross section in said upper half shell having its underside closed by a portion of said seam extending inwardly from said seam's second side edge, said first chamber, said crossover passage and said second chamber having cross sections which constantly increase in area from said first chamber inlet to said second chamber outlet, said seam having a portion of its one side edge offset upwardly a predetermined distance from the seam plane, an inlet tube connecting with said first chamber inlet, an outlet tube connecting with said outlet at a location substantially tangent with said second chamber's highest point of curvature, whereby water follows a U-shaped flow path upon entering said first chamber inlet at a point lower than said second chamber outlet, such that chilled water exits said second chamber outlet at said container's highest point obviating entrapment of air within said container, each of said first and second chambers formed with a plurality of baffle means whereby the water entering the inlet is made to change directions defining an undulating constantly diverging U-shaped flow path between the inlet and the oulet of said chambers.

2. A water container for installation in an above-freezing portion of a refrigerator with chilled water supplied to the container through a water valve connected between the container and a source of water under pressure, the container having first and second side-by-side elongated generally cylindrical sectioned water storage chambers formed by upper and lower half shells of plastic material sealed together along a horizontally disposed generally rectangular seam which circumscribes the shells and includes one portion forming a seam plane which bisects said first and second chambers, said first chamber having an inlet and said second chamber having an outlet, said inlet and said outlet both located adjacent the seam's first side edge, a crossover passage interconnecting said chambers at their closed ends, said cross-over passage formed with a generally semi-circular cross section in said upper half shell having its underside closed by a portion of said seam extending inwardly from said seam's second side edge, said first chamber, said crossover passage and said second chamber having diverging configurations such that their cross sections constantly increase in area from said first chamber inlet to said second chamber outlet, said seam having a portion of its first side edge offset upwardly a predetermined distance from the seam plane, an integral inlet tube extending from said first side edge connecting with said first chamber inlet, an integral outlet tube extending from said offset seam portion of said first side edge connecting with said outlet at a location substantially tangent with said second chamber's highest point of curvature, whereby water follows a U-shaped flow path upon entering said first chamber inlet at a point lower than said second chamber outlet, such that water exits said second chamber outlet at said container's highest point obviating entrapment of air within said container, each of said first and second chambers formed with a plurality of inwardly directed arcuate portions in horizontal section formed in staggered relation on opposite sides thereof, whereby the incoming water is made to change directions defining an undulating substantially last-in, last-out constantly diverging U-shaped flow path between the inlet and the outlet of said chambers.

3. In combination, a refrigerator cabinet having an above-freezing compartment therin provided with a cooling water container, water supplied to the container inlet via a plastic tube from a water valve connected to a source of water under pressure, the container outlet connected via a plastic tube to a water dispenser, the container having first and second side-by-side elongated generally cylindrical sectioned water storage chambers formed by upper and lower half shells of plastic material sealed together along a horizontally disposed seam which circumscribes the shells and includes one portion forming a seam plane which bisects said first and second chambers, said inlet in said first chamber and said outlet in said second chamber, said inlet and said outlet both located adjacent the seam's first side edge, a crossover passage interconnecting said chambers at their closed ends, said cross-over passage formed with a generally semi-circular cross section in said upper half shell having its underside closed by a portion of said seam extending inwardly from said seam's second side edge, said first chamber, said cross-over passage and said second chamber having cross sections which constantly increase in area from said first chamber inlet to said second chamber outlet, said seam having a portion of its first side edge offset upwardly a predetermined distance from the seam plane, an integral inlet tube extending from said first side edge connecting with said first chamber inlet, an integral outlet tube extending from said offset seam portion of said first side edge connecting with said outlet at a location substantially tangent with said second chamber's highest point of curvature, whereby water follows a U-shaped flow path upon entering said first chamber inlet at a point lower than said second chamber outlet, such that water exiting said second chamber outlet at said contain's highest point bleeding any entrapped air from said container via the shortest path between said inlet and said outlet, right-angled elbow connectors interconnecting said inlet tube with said source of water and said outlet tube with said water dispenser whereby said container may be rotated about the elbow connectors to a substantially vertical position for ease of cleaning, each of said first and second chambers formed with a plurality of inwardly directed arcuate portions in horizontal section formed in staggered relation on opposite sides thereof, whereby the incoming water is made to change directions definingan undulating substantially last-in, last-out constantly diverging U-shaped flow path between the inlet and the outlet of said chambers.

* * * * *